US009744584B2

(12) United States Patent
Jung et al.

(10) Patent No.: US 9,744,584 B2
(45) Date of Patent: Aug. 29, 2017

(54) HOT FORMED COILING MACHINE

(71) Applicant: DAE WON KANG UP CO., LTD., Seoul (KR)

(72) Inventors: Chan-Gi Jung, Incheon (KR); Ui-Seuk Yoon, Gyeonggi-do (KR)

(73) Assignee: DAE WON KANG UP CO., LTD., Seoul (KR)

( * ) Notice: Subject to any disclaimer, the term of this patent is extended or adjusted under 35 U.S.C. 154(b) by 344 days.

(21) Appl. No.: 14/396,515

(22) PCT Filed: Mar. 27, 2014

(86) PCT No.: PCT/KR2014/002618
§ 371 (c)(1),
(2) Date: Oct. 23, 2014

(87) PCT Pub. No.: WO2015/147356
PCT Pub. Date: Oct. 1, 2015

(65) Prior Publication Data

US 2015/0273565 A1 Oct. 1, 2015

(30) Foreign Application Priority Data

Mar. 25, 2014 (KR) ..... 10-2014-0034881

(51) Int. Cl.
*B21F 3/06* (2006.01)
*B21F 3/02* (2006.01)
(Continued)

(52) U.S. Cl.
CPC ..... *B21F 3/06* (2013.01); *B21F 3/02* (2013.01); *B21F 23/00* (2013.01); *B21F 35/00* (2013.01); *B21F 99/00* (2013.01); *B21F 3/027* (2013.01)

(58) Field of Classification Search
CPC .... B21F 3/00; B21F 3/02; B21F 3/027; B21F 3/04; B21F 3/06; B21F 3/08; B21F 3/10;
(Continued)

(56) References Cited

U.S. PATENT DOCUMENTS 820,507 A * 5/1906 Layne ..... B21F 3/02 140/149
1,981,566 A * 11/1934 Nigro ..... B21F 3/06 72/132
(Continued)

FOREIGN PATENT DOCUMENTS

JP 2001-300673 A 10/2001
JP 2003-033839 A 2/2003
(Continued)

*Primary Examiner* — Jimmy T Nguyen
*Assistant Examiner* — Gregory Swiatocha
(74) *Attorney, Agent, or Firm* — Rabin & Berdo, P.C.

(57) ABSTRACT

The present invention relates to a hot coiling machine, and an object of the invention is to provide a hot coiling machine that produces coil springs having various coil shapes and diameters from a heated wire without a mandrel. The present invention provides a hot coiling machine including: a center roll rotating by a drive unit; a feeding roll disposed near the center roll and facing an external surface of the center roll, the center roll being configured to move by a first positioning unit and being rotated by a drive unit thus moving a wire together with the center roll; a forming roll for forming the wire into a coil shape; and a pitch control unit disposed near the forming roll to come into contact with the coiled wire and pushing the coiled wire to provide the coiled wire with a desired pitch.

13 Claims, 13 Drawing Sheets

(51) Int. Cl.

| | |
|---|---|
| ***B21F 3/027*** | (2006.01) |
| ***B21F 35/00*** | (2006.01) |
| ***B21F 23/00*** | (2006.01) |
| ***B21F 99/00*** | (2009.01) |

(58) Field of Classification Search
CPC ..... B21F 3/12; B21F 23/00; B21F 23/002; B21F 23/005; B21F 99/00
USPC ..... 72/127, 135, 137, 138; 140/103, 124
See application file for complete search history.

(56) References Cited

U.S. PATENT DOCUMENTS 2,091,136 A * 8/1937 Blount ..... B21D 11/06 72/137
2,349,828 A * 5/1944 Moray ..... B21D 11/06 72/137
4,444,036 A * 4/1984 Shibata ..... B21F 3/10 700/95
4,530,224 A * 7/1985 Hild ..... B21C 47/063 242/566
4,587,821 A * 5/1986 Sykes ..... B21F 3/02 72/137
4,715,202 A * 12/1987 Shibata ..... B21F 3/04 72/14.1
4,823,576 A * 4/1989 Yoshioka ..... B21F 37/00 140/88
6,488,227 B1 * 12/2002 Miyaguchi ..... B21C 47/063 242/533.4
8,302,899 B2 * 11/2012 Kipping ..... B65H 18/26 242/541.4
2001/0002561 A1 * 6/2001 Shiraga ..... B23D 57/0053 83/13
2008/0264132 A1 * 10/2008 Tsuritani ..... B21F 3/02 72/135
2011/0226380 A1 * 9/2011 Graf ..... B21F 1/02 140/89
2011/0302981 A1 * 12/2011 Kipping ..... B21C 47/326 72/127
2013/0133391 A1 * 5/2013 Katsuyama ..... B21F 35/00 72/135
2015/0252863 A1 * 9/2015 Ono ..... B21F 3/02 267/166

FOREIGN PATENT DOCUMENTS

| | | | |
|---|---|---|---|
| JP | 4612552 | B2 | 1/2011 |
| JP | 4913703 | B2 | 4/2012 |
| KR | 10-1996-0021246 | A | 7/1996 |

* cited by examiner

HOT FORMED COILING MACHINE

TECHNICAL FIELD

The present invention relates to a hot coiling machine that produces a hot coiled spring in such a way as to subject a heated wire having a predetermined length to coiling work, and more particularly to a hot coiling machine that can produce coil springs having various diameters and shapes without the replacement of components used in coiling work for a coil spring.

BACKGROUND ART

Generally, a spring is used for the purpose of shock-absorbing and accumulating energy through elastic force of a steel wire, or for the purpose of assuring of various functions of machine elements using a restoring force occurring after compression.

A coil spring that is prepared by coiling a round wire is the most typical spring shape. The coil spring may be classified into a cold coiled spring and a hot coiled spring depending on the production method.

The cold coiled spring is produced in such a way as to directly coil an OT wire (Oil Tempered Wire) or an IT wire (Induction Treatment Wire) that is previously heat-treated during production of a spring wire without an additional heating operation, and the hot coiled spring is produced in such a way that a wire is cut into a wire piece having a length corresponding to a spread length of a hot coiled spring to be produced, the cut wire is heated to a predetermined temperature and coiled, and the coiled wire is subjected to a heat-treatment to have a desired strength.

FIG. 1 is a view showing a conventional process of producing a cold coiled spring.

For the production of a cold coiled spring, a wire that has been subjected to a predetermined heat treatment is rolled, and the rolled wire is transferred to an apparatus 20 for manufacturing a coil spring by means of a feeding unit 10 composed of a plurality of rolls.

The apparatus 20 produces a cold coiled spring in such a way that the wire supplied through the feeding unit 10 is coiled by means of a plurality of forming rolls 21, and then a rear end of the coiled wire is cut using a cutting unit 30.

Because the cold coiled spring is produced from a wire that is previously heat-treated so as to have a desired strength, the coil spring is expensive due to the increased cost of raw material and it is not easy to produce a coil spring having a large coil diameter.

FIG. 2 is a view showing a conventional process of producing a hot coiled spring.

For the production of a hot coiled spring, a wire is first cut into a wire piece having a length corresponding to a spread length of a hot coiled spring to be produced, the cut wire is heated in a heating unit, and the heated wire is coiled by means of a hot coiling machine 40.

The hot coiling machine 40 produces a coil spring by holding an end of the wire using a mandrel 41 and rotating the mandrel 41. While the coil spring that is produced in this way requires an additional heating unit, price of the coil spring can be decreased because the raw material is inexpensive compared to a cold coiled spring.

However, in order to produce coil springs having different coil diameters or shapes, the coiling machine that uses the mandrel inevitably requires mandrels corresponding to the various coil springs. Consequently, various types of mandrels have to be prepared and a required one among the mandrels has to be selected and used depending on an application, the working efficiency is deteriorated.

Of course, though a wire can be deformed into a coil spring shape by means of a plurality of forming rolls as in the production of cold coiled spring, the process using the forming rolls requires a compulsory transfer of the wire toward the forming rolls by means of a feeding unit. During the transfer of the wire, the plurality of rolls come into contact with the wire thus causing heat loss of the wire. Due to the heat loss, a temperature of the wire introduced into the coiling machine is decreased thus impeding proper forming of the wire.

PRIOR ART DOCUMENT

Patent Document (Patent Document 1) Korean Patent No. 1996-021246 (Laid-Open on Jul. 18, 1996.)

DISCLOSURE

Technical Problem

Accordingly, the present invention has been made keeping in mind the above problems occurring in the prior art, and an object of the present invention is to provide a hot coiling machine that can produce coil springs having various coil shapes and diameters from a wire heated to a predetermined temperature without the use of a mandrel.

Another object of the present invention is to provide a hot coiling machine that can minimize contact between a heated wire and a roll adapted to transfer the wire and thus can minimize heat loss of the wire.

A further object of the present invention is to provide a hot coiling machine that can control a pitch of a coil spring in such a way as to push a coiled wire exiting a forming roll by means of a separate pitch control unit, thus minimizing damage to the wire and enabling production of coil springs having various pitches.

Yet another object of the present invention is to provide a hot coiling machine that intentionally bends a leading end of a wire in a turning direction of the coil spring before deforming the wire into a coil shape, thus allowing the wire to be smoothly coiled under the condition that it is in contact with an external surface of the forming roll.

Technical Solution

In order to accomplish the above objects and overcome the above problems, the present invention provides a hot coiling machine including: a center roll adapted to rotate via force generated from a drive unit; a feeding roll disposed near the center roll and having an external surface facing an external surface of the center roll, the feeding roll being configured to move close to or away from the center roll by means of a first positioning unit provided at a body and being rotated via force generated from a drive unit thus moving a wire together with the center roll; at least one forming roll for forming the wire transferred by rotations of the center roll and the feeding roll into a coil shape; and a pitch control unit disposed near the at least one forming roll to come into contact with the coiled wire exiting the at least one forming roll, and which pushes a lateral surface of the coiled wire exiting the at least one forming roll to provide the coiled wire with a desired pitch.

The pitch control unit may include: a contact member disposed to come into contact with the coiled wire exiting the at least one forming roll while intersecting with the coiled wire; and a pitch control actuator for pushing or pulling the wire to cause the contact member to move close to or away from the wire, thus adjusting a pitch of the coiled wire.

The pitch control actuator may include: a pitch control motor installed at the body; and a slider coupled to a screw shaft extending from the pitch control motor and being moved along the screw shaft by rotation of the screw shaft, the slider being also coupled to the contact member to move the contact member by the pitch control motor.

The contact member may include a roller having an external surface in contact with the wire and is rotated by friction with the wire.

The contact member may configured such that, based on a vertical reference line that runs through a center of the contact member, an upper end is positioned close to the second forming roll and a lower end is positioned away from the second forming roll.

The hot coiling machine according to the present invention may further include a bending unit for pushing a leading end of the wire fed between the feeding roll and the at least one forming roll to bend the leading end of the wire in a turning direction of the coiled wire.

The bending unit may include: a bending pusher rotatably fitted over a rotating shaft of the at least one forming roll positioned near the feeding roll; a spring that is stretched and accumulates elastic force for restoring the bending pusher to an initial position during bending of the wire by the bending pusher; and a bending actuator for pressing a lateral surface of an end of the bending pusher to rotate the bending pusher about the rotating shaft and thus to bend a leading end of the wire.

The bending actuator may include a hydraulic cylinder or an electric cylinder.

The at least one forming roll may include: a first forming roll disposed near the center roll and having an external surface a facing the wire transferred by the center roll and the feeding roll, the first forming roll being moved close to or away from the center roll by means of a second positioning unit provided at the body; and a second forming roll disposed near the first forming roll and having an external surface facing the wire deformed by the first forming roll, the second forming roll being moved close to or away from the center roll by means of a third positioning unit.

The first positioning unit may include: a hydraulic cylinder installed at the body; and a movable block installed at the body and being moved to move the feeding roll by means of the hydraulic cylinder.

The drive unit may include: a first drive motor fixed to the body constituting the hot coiling machine; a second drive motor fixed to the body; a first universal joint that connects the first drive motor with the center roll to transmit rotational force generated from the first drive motor to the center roll; and a second universal joint that connects the second drive motor with the feeding roll to transmit rotational force generated from the second drive motor to the feeding roll.

The hot coiling machine according to the present invention may further include a stopper for stopping the wire at a predetermined position in order to set an initial position of the wire to be supplied between the center roll and the feeding roll.

The second positioning unit may include: a first base member hingedly coupled to the body to be rotatable about a hinge shaft; a first positioning motor installed at the first base member; a first actuator coupled to a screw shaft extending from the first positioning motor and moving in a direction parallel to the screw shaft by rotation of the screw shaft, the first actuator including a rotating shaft for rotatably supporting the first forming roll; a second base member hingedly coupled to the body near the first base member to be rotatable about a hinge shaft; a second positioning motor installed at the second base member; and a second actuator coupled to a screw shaft extending from the second positioning motor and moving in a direction parallel to the screw shaft by rotation of the screw shaft, an end of the second actuator being coupled to the first base member to push or pull the first base member thus rotating the first base member about the hinge shaft.

The third positioning unit may include: a third base member hingedly coupled to the body to be rotatable about a hinge shaft; a third positioning motor installed at the third base member; a third actuator coupled to a screw shaft extending from the third positioning motor and moving in a direction parallel to the screw shaft by rotation of the screw shaft, an end of the third positioning motor including a rotating shaft for rotatably supporting the second forming roll; a fourth base member hingedly coupled to the body near the third base member to be rotatable about a hinge shaft; a fourth positioning motor installed at the fourth base member; and a fourth actuator coupled to a screw shaft extending from the fourth positioning motor and moving in a direction parallel to the screw shaft by rotation of the screw shaft, an end of the fourth actuator being coupled to the third base member to push or pull the third base member thus rotating the third base member about the hinge shaft.

The hot coiling machine according to the present invention may further include a guide roll disposed near the center roll and above the wire supplied between the center roll and the feeding roll so as to press the wire by it's own weight and to thus reliably support movement of the wire, the guide roll being installed at a lever that is hingedly coupled to the body to be rotatable about a hinge shaft.

Advantageous Effects

According to the present invention having the above-mentioned features, the hot coiling machine can produce coil springs having various coil shapes and diameters from a wire heated to a predetermined temperature without the use of a mandrel.

Furthermore, by the configuration in which a wire is transferred to the forming roll by means of the center roll and the feeding roll, the number of rolls that come into contact with the wire can be reduced and thus heat loss of the heated wire can be minimized.

Furthermore, a pitch of a coil spring can be controlled in such a way that a coiled wire exiting the forming roll is pushed by means of a separate pitch control unit, and the wire is worked into a coil shape under the condition that rolls for deforming the wire into a coil shape are positioned on the same plane. Consequently, damage to the wire due to unstable contact between the wire and the rolls can be prevented.

Furthermore, since the coiling work is performed after a leading end of a wire fed between the center roll and the feeding roll is bent in a turning direction of the coil spring, the wire that is transferred by means of the center roll and the feeding roll can be smoothly coiled under the condition that it is in contact with an external surface of the forming roll.

DESCRIPTION OF REFERENCE NUMERALS

Figure 1:
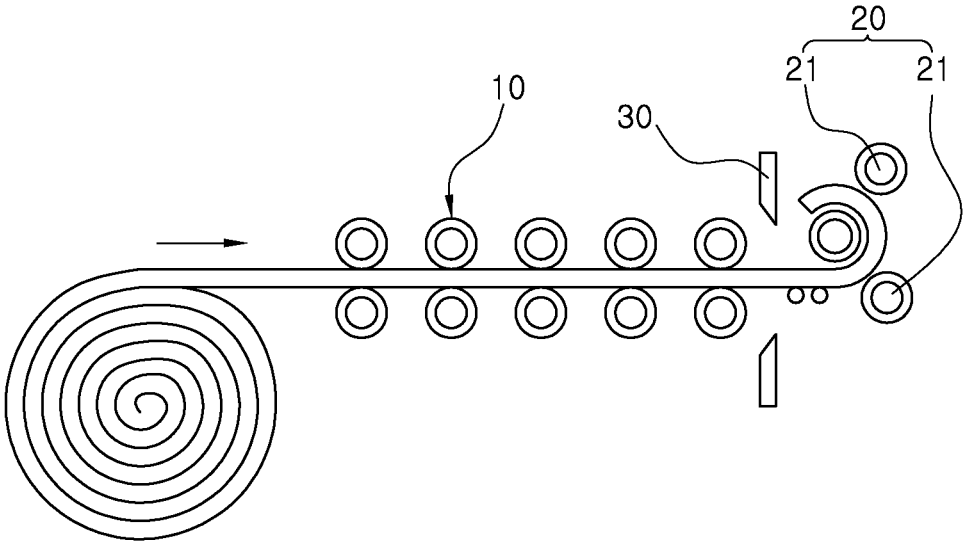
FIG. 1 (PRIOR ART)
FIG. 1 is a view showing a conventional process of producing a cold coiled spring.
Figure 2:
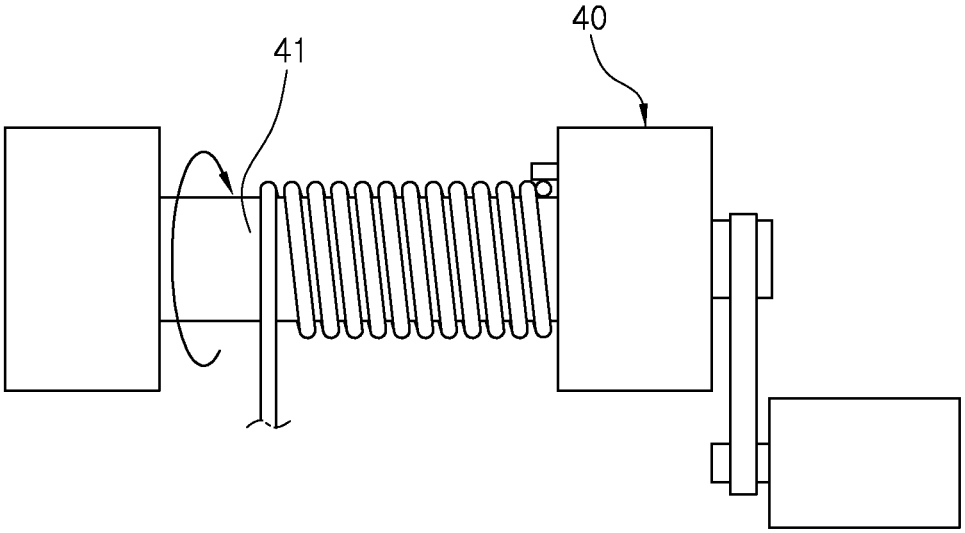
FIG. 2 (PRIOR ART)
FIG. 2 is a view showing a conventional process of producing a hot coiled spring.

<Description of Reference Numerals for Substantial Parts in the Drawings>

| | |
|---|---|
| 100: body | 110: center roll |
| 120: feeding roll | 130: center roll |
| 131: first forming roll | 132: second forming roll |
| 140: pitch control unit | 141: contact member |
| 142: pitch control actuator | |
| 1421: pitch control motor | |
| 1422: slider | 1423: screw shaft |
| 150: bending unit | 151: bending pusher |
| 152: spring | 153: bending actuator |
| 160: stopper | 170: guide roll |
| 171: lever | 200: drive unit |
| 210: first drive motor | 220: second drive motor |
| 230: first universal joint | 240: second universal joint |
| 310: first positioning unit | 311: hydraulic cylinder |
| 312: movable block | 320: second positioning unit |
| 321: first base member | 322: first positioning motor |
| 3221: screw shaft | 323: first actuator |
| 324: second base member | 325: second positioning motor |
| 3251: screw shaft | 326: second actuator |
| 327: rotating shaft | 330: third positioning unit |
| 331: third base member | 332: third positioning motor |
| 3321: screw shaft | 333: third actuator |
| 334: fourth base member | 335: fourth positioning motor |
| 336: fourth actuator | 337: rotating shaft |

BEST MODE

Hereinafter, a preferred embodiment of the present invention will be described with reference to the accompanying drawings. When the functions of conventional elements and the detailed description of elements related with the present invention may make the gist of the present invention unclear, a detailed description thereof will be omitted.

The hot coiling machine according to the present invention is configured to produce a hot coiled spring in such a way that a wire that has been heated by a separate heating unit is transferred by means of two rolls, the transferred wire is deformed into a coil shape by means of a forming roll, and a lateral surface of the coiled wire exiting the forming roll is pushed by a separate roller so as to provide the coiled wire with a desired pitch.

Referring to FIGS. 1 to 15, shown is a structure of the hot coiling machine according to a preferred embodiment of the present invention.

Figure 3:
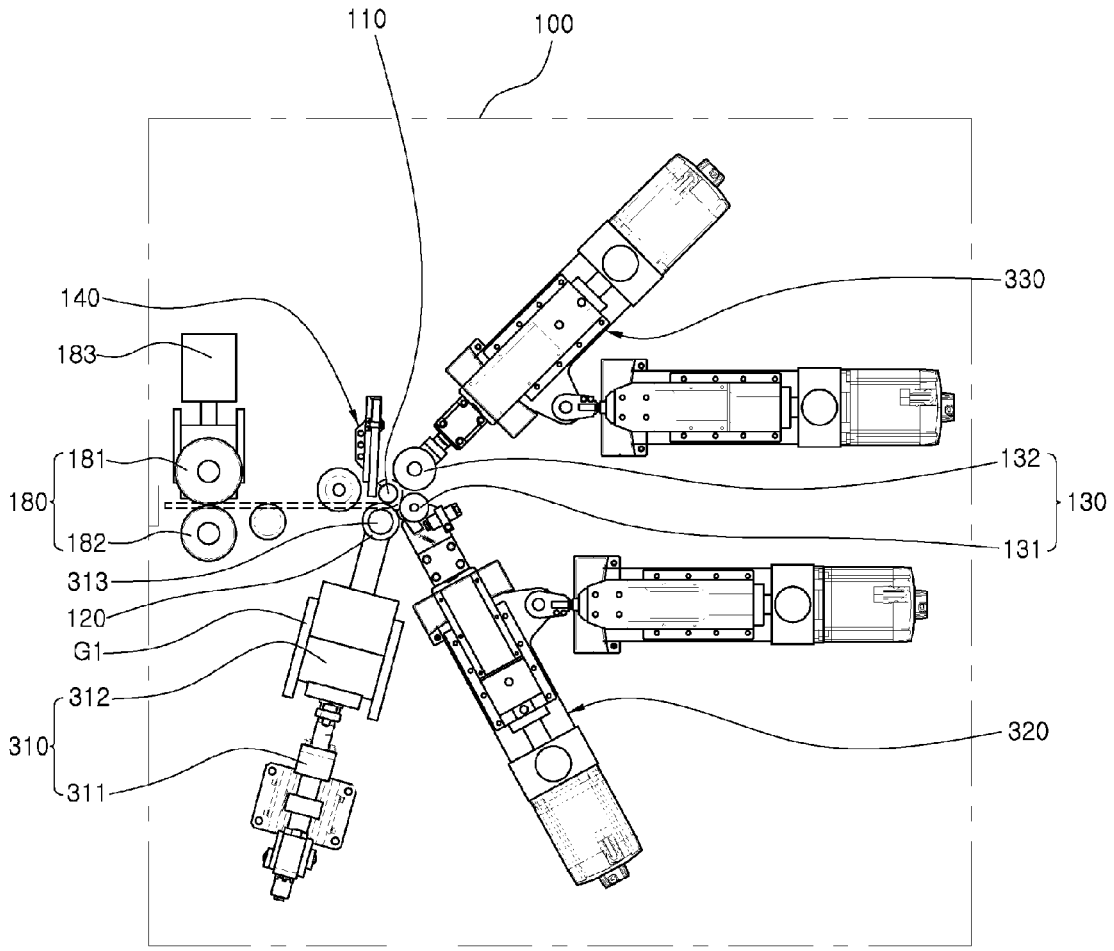
FIG. 3 is a front view showing a structure of a hot coiling machine according to the present invention.
Figure 4:
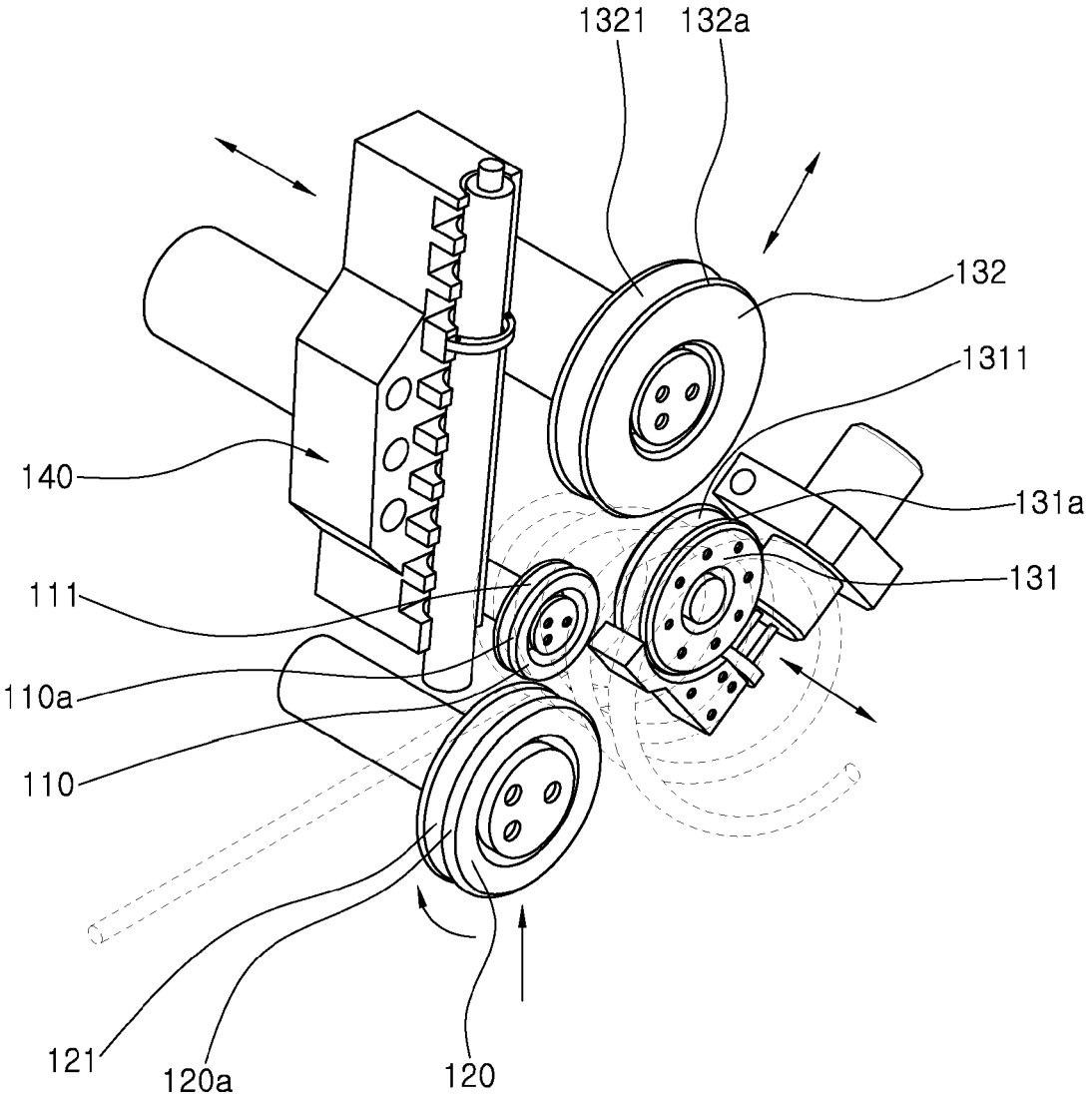
FIG. 4 is a perspective view showing structures of substantial parts of the hot coiling machine according to the present invention.
Figure 5:
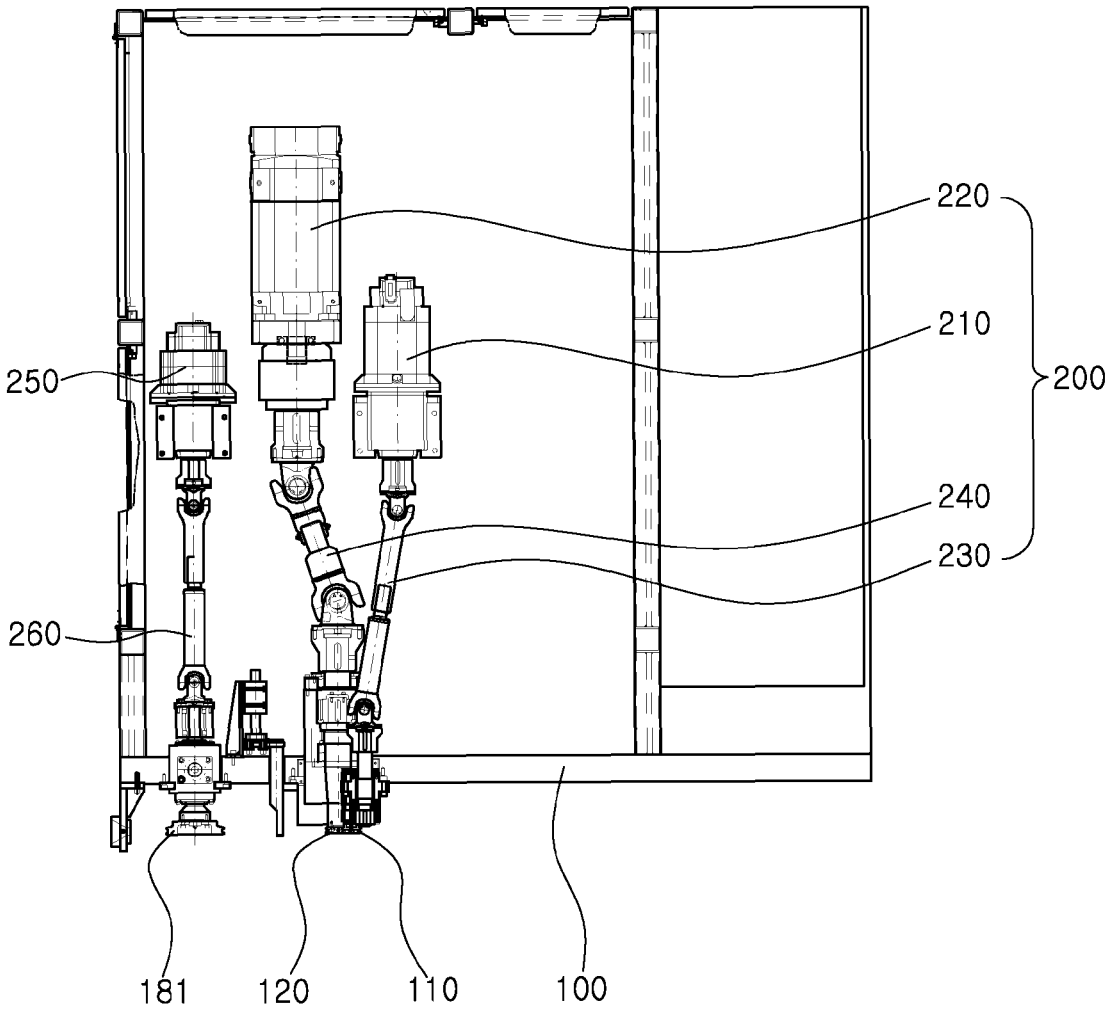
FIG. 5 is a plan view showing a structure of a drive unit according to the present invention
Figure 6:
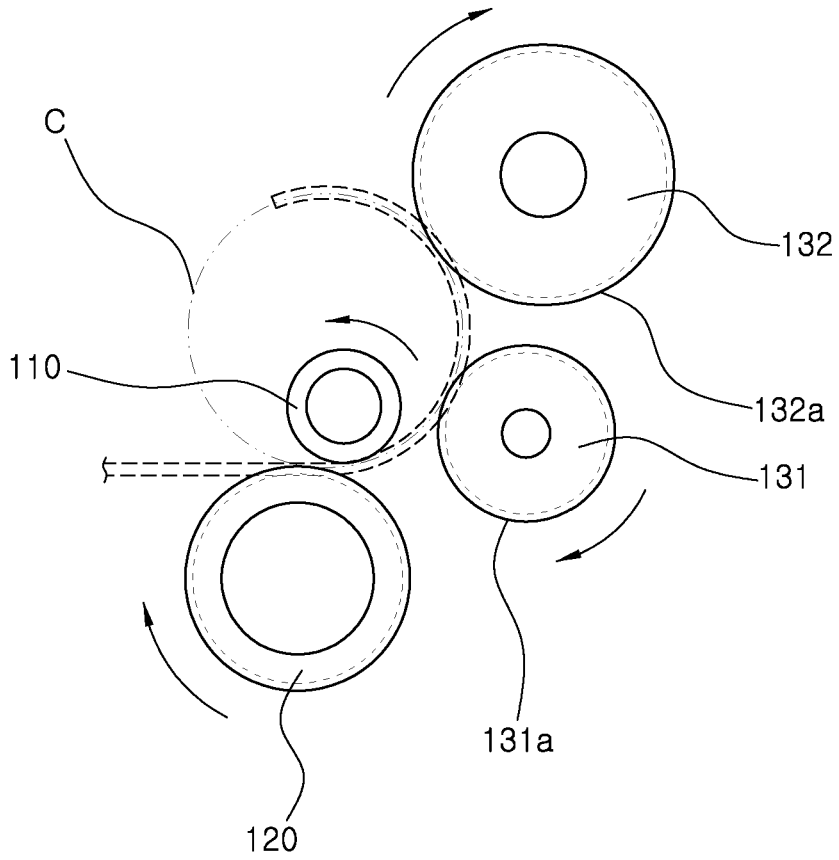
FIG. 6 is a front view showing an arrangement of first and second forming rolls according to the present invention.
Figure 7:
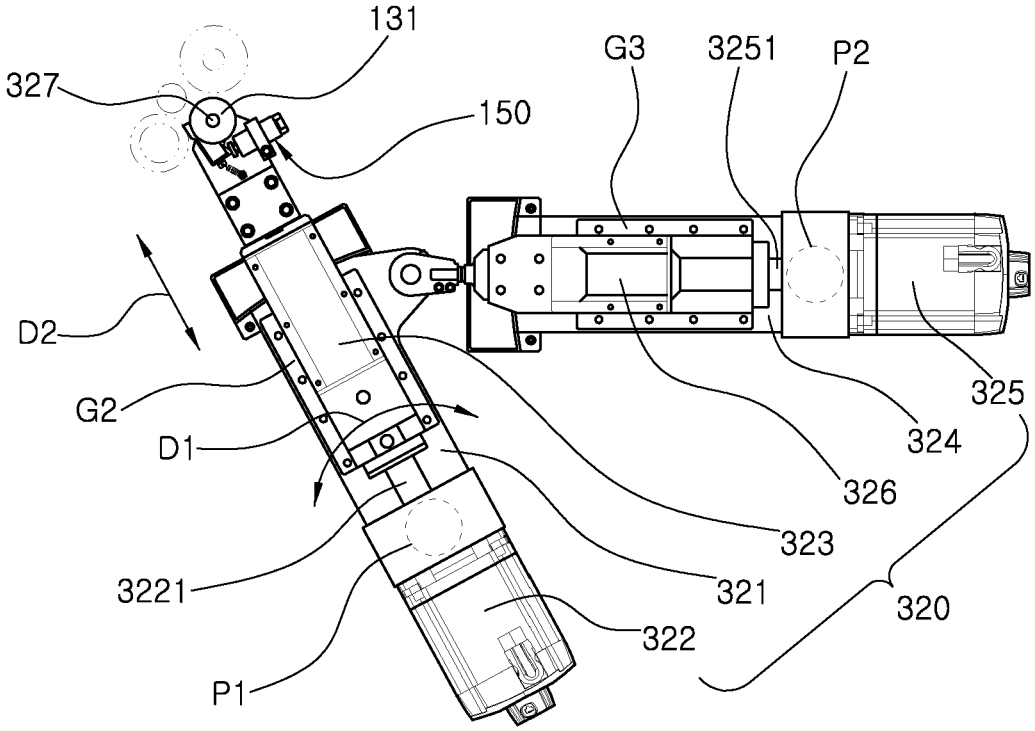
FIG. 7 is a front view showing a structure of a second positioning unit according to the present invention.
Figure 8:
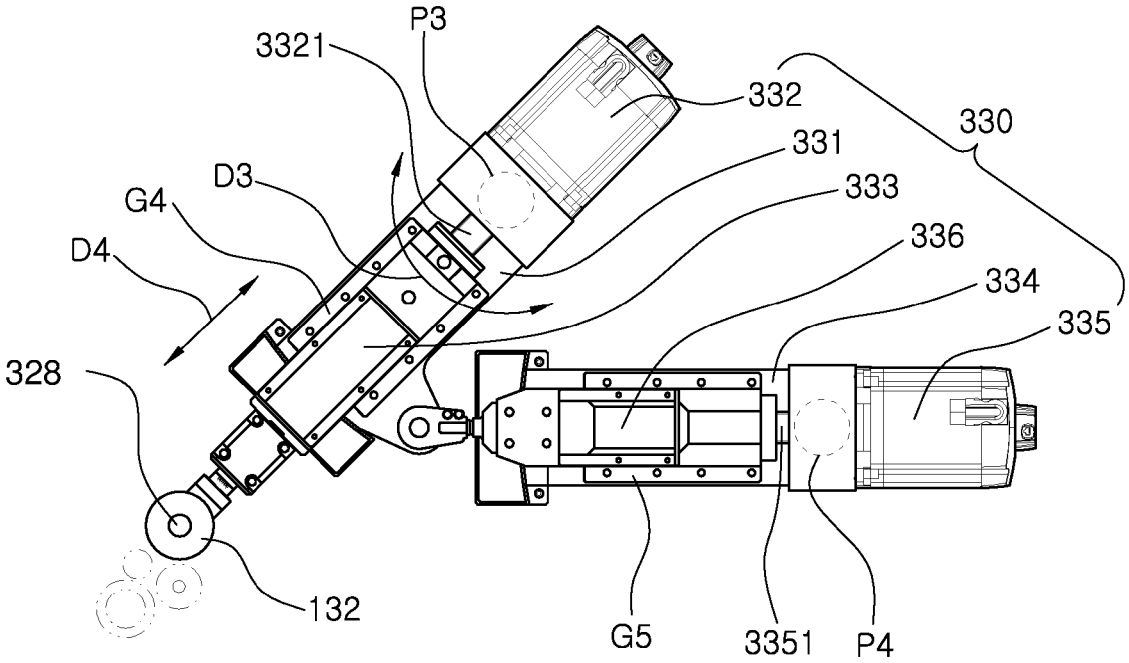
FIG. 8 is a front view showing a structure of a third positioning unit according to the present invention.

FIG. 3 is a front view showing a structure of the hot coiling machine according to the present invention, FIG. 4 is a perspective view showing structures of substantial parts of the hot coiling machine according to the present invention, FIG. 5 is a plan view showing a structure of a drive unit according to the present invention, FIG. 6 is a front view showing an arrangement of first and second forming rolls according to the present invention, FIG. 7 is a front view showing a structure of a second positioning unit according to the present invention, and FIG. 8 is a front view showing a structure of a third positioning unit according to the present invention.

The hot coiling machine according to the present invention comprises a center roll 110, a feeding roll 120, a forming roll 130, and a pitch control unit 140. Of course, components constituting the hot coiling machine including the above-mentioned components (the center roll, the feeding roll, the forming roll and the pitch control unit) are installed at proper positions outside or inside a box-shaped body 100. The components constituting the hot coiling machine that are to be installed at the proper positions of the body 100 may be installed in various configurations depending on a surrounding environment of a site at which the hot coiling machine is used or installed or operator's characteristics.

In the following description of the hot coiling machine according to a preferred embodiment of the present invention, the center roll 110, the feeding roll 120, the forming roll 130 and the pitch control unit 140 are assumed as being installed at a front surface of the body 100.

The center roll 110 that is a roll associated with transfer of a wire is configured to rotate by a rotational force generated from a drive unit 200. For reference, the configuration of the drive unit 200 will be specifically described later. It is to be appreciated that the drive unit 200 includes a motor for generating a rotational force and the center roll 110 rotates via the force supplied thereto.

Meanwhile, an external surface of the center roll 110 is provided with an annular groove 111 having a semicircular section, and the wire is partially engaged in the groove 111, thus assuring reliable contact between the center roll 100 and the wire.

The feeding roll 120 that is a roll functioning to transfer the wire together with the center roll 110 is positioned near the center roll 110 such that an external surface 120*a* of the feeding roll 120 faces the external surface 110*a* of the center roll 110. The external surface 120*a* of the feeding roll 120 is also provided with an annular groove 121 having a semicircular section. Referring to FIGS. 3 and 4, shown is a structure in which the feeding roll 120 is positioned below the center roll 110.

The feeding roll 120 is configured to move to or away from the center roll 110 by means of a first positioning unit 310 installed at the body 100 and to rotate via force generated from the drive unit 200.

When it is intended to supply a wire between the center roll 110 and the feeding roll 120, the feeding roll 120 moves away from the center roll 110 to define a space so that the wire can be smoothly transferred between the center roll 110 and the feeding roll 120. After the wire is transferred to a desired position, the feeding roll 120 again moves closer to the center roll 110 to press the wire positioned between the center roll 110 and the feeding roll 120.

When the wire is pressed by the movement of the feeding roll 120, it is preferable to provide a pressure to the wire such that the wire can be steadily transferred by rotations of the center roll 110 and the feeding roll 120. The pressure may be set to be a value that is previously determined through a test depending on a material or size of the wire.

The first positioning unit 310 that is designed to move the feeding roll 120 to or away from the center roll 110 may be composed of a hydraulic cylinder.

More specifically, the first positioning unit 310 may comprise a hydraulic cylinder 311 fixedly installed on the body 100 and a movable block 312 that is installed on the body 100 and moves by drive of the hydraulic cylinder 311 thus moving the feeding roll 120.

In this regard, the movable block 312 is coupled and supported to the body 100 via a usual guide G1 such as a rail so as to be moved along a desired path. The movable block 312 is provided at an end thereof with a rotating shaft 313 that is fitted in the feeding roll 120 and rotates therewith.

The drive unit 200 that is intended to rotate the center roll 110 and the feeding roll 120 comprises a first drive motor 210, a second drive motor 220, a first universal joint 230 and a second universal joint 240.

The first drive motor 210 and the second drive motor 220 are fixedly installed in the body 100. At this point, the first drive motor 210 is connected to the center roll 110 via the first universal joint 230 so as to transmit a rotational force to the center roll 110, and the second drive motor 220 is connected to the feeding roll 120 via the second universal joint 240 so as to transmit a rotational force to the feeding roll 120.

For reference, a spacing between the center roll 110 and the feeding roll 120 is not enough to accommodate both the motors parallel to each other. The feeding roll 120 is configured to be moved by means of the first positioning unit 310.

Therefore, the present invention incorporates the above-described drive unit 200 in order to overcome a problem of that there is not enough space to accommodate the first and second drive motors 210, 220 and a problem in transmission of rotational force to the movable feeding roll 120.

The forming roll 130 that functions to deform the wire transferred by rotations of the center roll 110 and the feeding roll 120 into a coil shape may be composed of at least one roll. The forming roll 130 preferably comprises a first forming roll 131 having an external surface 131*a* facing the wire transferred by the center roll 110 and the feeding roll 120, and a second forming roll 132 having an external surface 132*a* facing the wire deformed by the first forming roll 131 and disposed near the first forming roll 131.

Similarly to the center roll 110 and the feeding roll 120, the first forming roll 131 and the second forming roll 132 are provided at external surfaces thereof with grooves 1311, 1321 each having a semicircular section, respectively.

The first forming roll 131 serves as an idler roll that is rotated not by an additional drive source but by friction with the wire. The first forming roll 131 controls a coil diameter formed by the wire in such a manner as to move to or away from the center roll 110 by means of the second positioning unit 320.

Similarly to the first forming roll 131, the second forming roll 132 serves as an idler roll that is rotated not by an additional drive source but by friction with the wire. The second forming roll 132 controls a coil diameter formed by the wire in such a manner as to move to or away from the center roll 110 by means of the third positioning unit 330.

In this way, the coil diameter may be controlled by the movement of the first forming roll 131 and the second forming roll 132. At this point, in order to form the wire into a coil having a desired diameter by the first forming roll 131 and the second forming roll 132 together with the feeding roll 120, the first forming roll 131, the second forming roll 132 and the feeding roll 120 are positioned such that the external surfaces thereof are circumscribed to a circle corresponding to the desired diameter of the coil.

In other words, because the position of the feeding roll 120 does not change during the coiling operation, the positions of the first forming roll 131 and the second forming roll 132 are controlled in accordance with the diameter of the coil such that the external surface 131*a* of the first forming roll 131 and the external surface 132*a* of the second forming roll 132 are always circumscribed to the circle (c) corresponding to the diameter of the coil to be produced.

The second positioning unit 320 and the third positioning unit 330 that can implement the displacements of the first forming roll 131 and the second forming roll 132 are configured as described below.

The second positioning unit 320 comprises a first base member 321, a first positioning motor 322, a first actuator 323, a second base member 324, a second positioning motor 325 and a second actuator 326.

The first base member 321 is hingedly coupled to the body 100 to be rotatable about a hinge shaft P1. With the rotation of the first base member 321 about the hinge shaft P1, the first forming roll 131 is moved in a direction of D1 denoted in FIG. 7.

The first positioning motor 322 is installed on the base member 321 and generates power required to move the first forming roll 131 in a direction of D2 denoted in FIG. 7.

The first actuator 323 is coupled to a screw shaft 3221 extending from the first positioning motor 322, and is coupled to the first base member 321 via a guide G2 such as a rail, with the result that the first actuator 323 moves in a direction of D2 by rotation of the screw shaft 3221.

The first actuator 323 is provided at an end thereof with a rotating shaft 327 for rotatably supporting the first forming roll 131 and a bending unit 150 described later.

The second base member 324 is positioned near the first base member 321, and is hingedly coupled to the body 100 to be rotatable about a hinge shaft P2.

The second positioning motor 325 is fixedly installed on the second base member 324.

The second actuator 326 is coupled to a screw shaft 3251 extending from the second positioning motor 325, and is coupled to the second base member 324 via a guide G3 such as a rail, thereby the second actuator 326 moves in a direction parallel to the screw shaft 3251 by rotation of the screw shaft 3251. Furthermore, the second actuator 326 is coupled to the first base member 321, and is moved by the second positioning motor 325 to push or pull the first base member 321, thus implementing the movement of the first forming roll 131 in the direction of D1.

The second positioning unit 320 that is configured in this way incorporates both the motors as drive sources to cause an arcuate movement in the direction of D1 as well as a linear movement in the direction of D2, thus allowing the first forming roll 131 to be freely and accurately moved to the desired position.

The third positioning unit 330 comprises a third base member 331, a third positioning motor 332, a third actuator 333, a fourth base member 334, a fourth positioning motor 335 and a fourth actuator 336. Since the operating principle of the third positioning unit 330 is identical to that of the second positioning unit 320, only the components of the third positioning unit 330 are briefly described.

The third base member 331 is hingedly coupled to the body 100 to be rotatable about a hinge shaft P3. Thanks to the rotation of the third base member 331 about the hinge shaft P3, the movement of the second forming roll 132 in a direction of D3 is implemented.

The third positioning motor 332 is installed on the third base member 331 to generate power for moving the second forming roll 132 in a direction of D4.

The third actuator 333 is coupled to a screw shaft 3321 extending from the third positioning motor 332, and is coupled to the third base member 331 via a guide G4 such as a rail, thereby the third actuator 333 is moved in a direction of D4 by rotation of the screw shaft 3321. The third actuator 333 is provided at an end thereof with a rotating shaft 328 for rotatably supporting the second forming roll 132.

The fourth base member 334 is positioned near the third base member 331, and is hingedly coupled to the body 100 so as to be rotatable about a hinge shaft P4.

The fourth positioning motor 335 is fixedly installed on the fourth base member 334.

The fourth actuator 336 is coupled to a screw shaft 3351 extending from the fourth positioning motor 335, and is coupled to the fourth base member 334 via a guide G5 such as a rail, thereby the fourth actuator 336 moves in a direction parallel to the screw shaft 3351 by rotation of the screw shaft 3351. Furthermore, the fourth actuator 336 is coupled to the third base member 331, and pushes or pulls the third base member 331, thus implementing the movement of the second forming roll 132 in the direction of D3.

The second positioning unit 320 and the third positioning unit 330 move the first forming roll 131 and the second forming roll 132 under the control of a controller (not shown), thus enabling coil springs having various diameters to be produced. In particular, not only a linear coil spring having a consistent diameter along a length but also springs having a varying diameter such as a pig tail spring, a conical spring and an hourglass-shaped spring can be produced.

Figure 9:
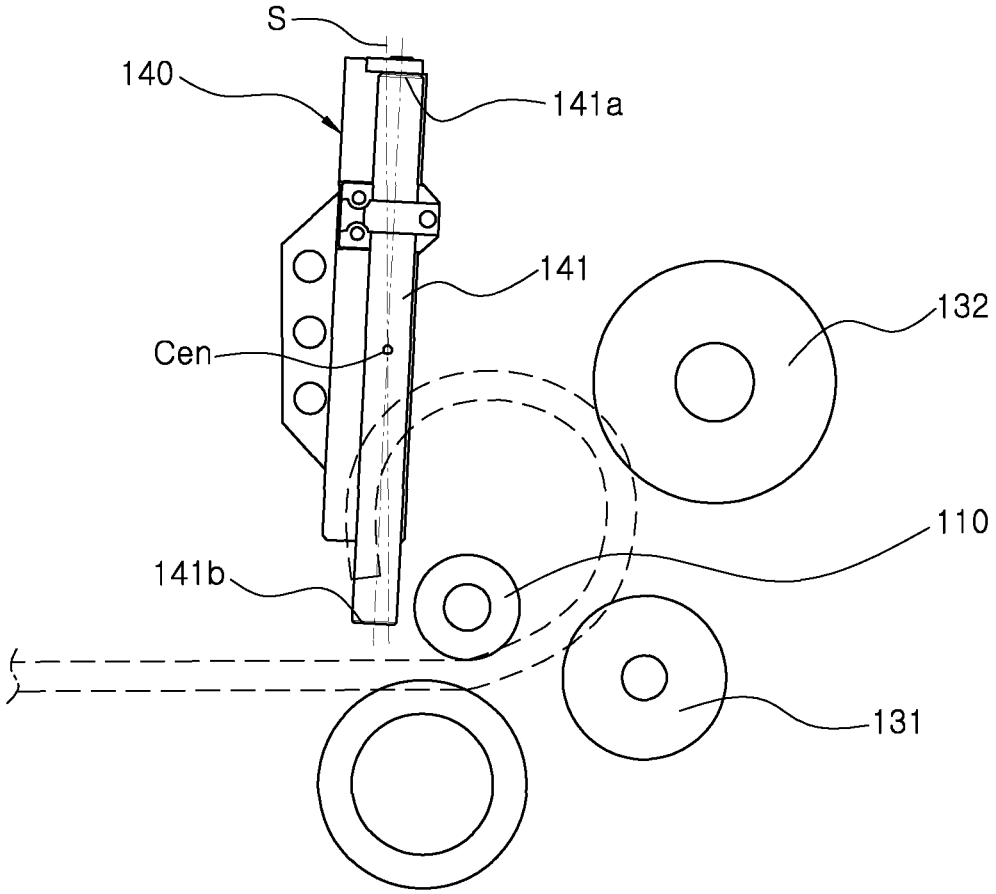
FIG. 9 is a front view of the pitch control unit according to the present invention
Figure 10:
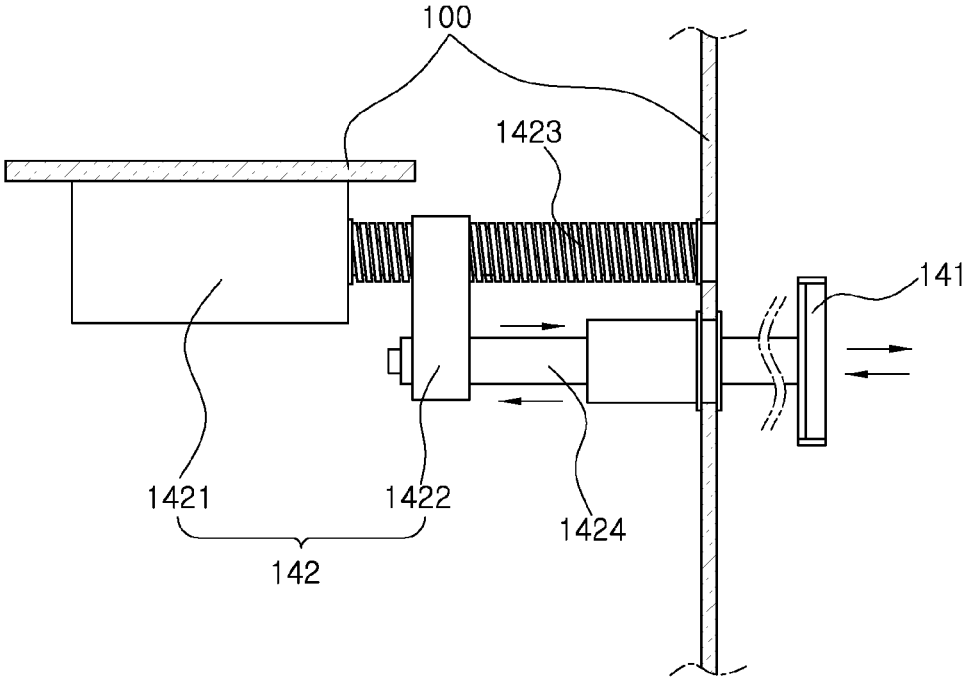
FIG. 10 is a side elevation view showing an operating structure of the pitch control unit according to the present invention.
Figure 11:
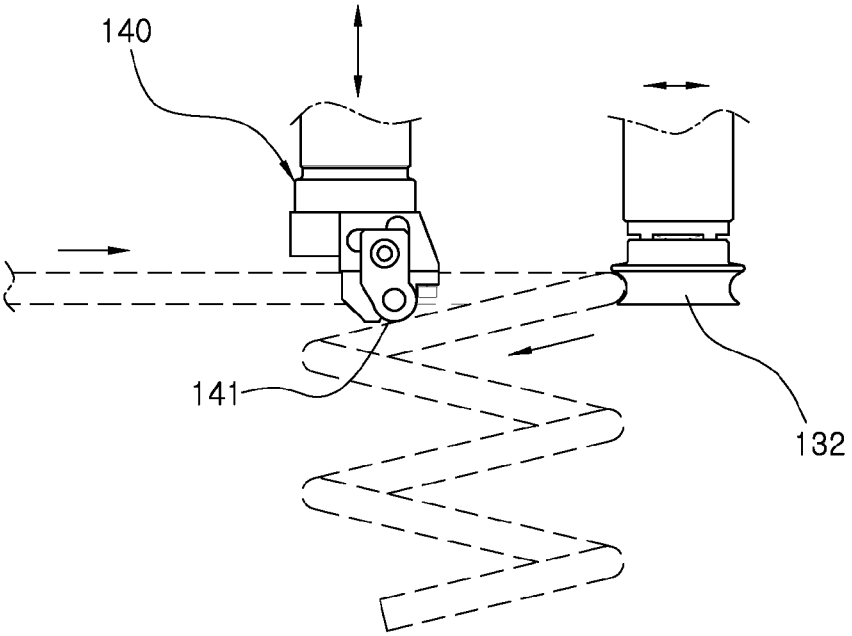
FIG. 11 is a plan view showing an operation of controlling a pitch of a coil spring by the pitch control unit according to the present invention.

FIG. 9 is a front view of the pitch control unit according to the present invention, FIG. 10 is a side elevation view showing an operating structure of the pitch control unit according to the present invention, and FIG. 11 is a plan view showing an operation of controlling a pitch of a coil spring by the pitch control unit according to the present invention.

The pitch control unit 140 functions to push a coil-shaped wire deformed by first forming roll 131 and the second forming roll 132 so as to define a pitch between adjacent turns of the coil-shaped wire, and comprises a contact member 141 and a pitch control actuator 142.

The contact member 141 is positioned to intersect with the coil-shaped wire. Although the contact member 141 may be composed of any of a bar and a roller having a length sufficient to come into contact with coil-shaped wires having various diameters, it is preferable that the contact member 141 is composed of the roller in order to minimize friction with the wire.

The wire that is deformed by and exits the second forming roll 132 is not a linear wire but a coil-shaped wire. In order that the contact member 141 comes into contact with the wire more steadily and pushes the wire, it is preferable that the contact member 141 is disposed to be inclined.

More specifically speaking about the configuration of the contact member 141, based on a vertical reference line S that runs through the center (Cen) of the contact member 141, an upper end 141*a* is positioned close to the second forming roll 132 and a lower end 141*b* is positioned away from the second forming roll 132.

When the center roll 110, the feeding roll 120, the first forming roll 131 and the second forming roll 132 are installed on the front surface of the body 100 and the contact member 141 is disposed at the left side of the second forming roll 132 (based on FIG. 9), the contact member 141 is inclined such that the upper end thereof faces to the right of the second forming roll 132 and the lower end thereof faces to the left of the second forming roll 132. In this configuration, since the coil-shaped wire exiting the second forming roll 132 enters and comes into contact with the contact member 141 in an inclined position with respect to the contact member 141, a smooth contact between the wire and the contact member 141 is induced and thus damage to the wire that may occur upon the contact between the wire and the contact member 141 can be minimized.

The pitch control actuator 142 is configured to control a pitch of a coil spring in such a way as to move the contact member 141 to or away from the wire and to push or pull the contact member 141 in contact with the wire thus controlling a position of the contact member 141. The pitch control actuator 142 comprises a pith control motor 1421 and a slider 1422.

The pitch control motor 1421 is fixedly installed in the body 100 and generates power required to move the contact member 141.

The slider 1422 functions to connect the pitch control motor 1421 with the contact member 141 thus allowing the contact member 141 to be moved by the drive of the pitch control motor 1421. More specifically, the slider 1422 is coupled to a screw shaft 1423 so as to be moved in a direction parallel to the screw shaft 1423 when the screw shaft 1423 rotates, and is coupled to the contact member 141 via a connecting rod 1424 so as to move the contact member 141.

In order to allow the wire that is sequentially transferred through the external surface of the first forming roll 131 and the external surface of the second forming roll 132 by the center roll 110 and the feeding roll 120 to be smoothly deformed without substantial friction with the first and second forming rolls 131, 132, the hot coiling machine further includes the bending unit 150 for bending a leading end of the wire in a turning direction of a coil spring to be produced.

Figure 12:
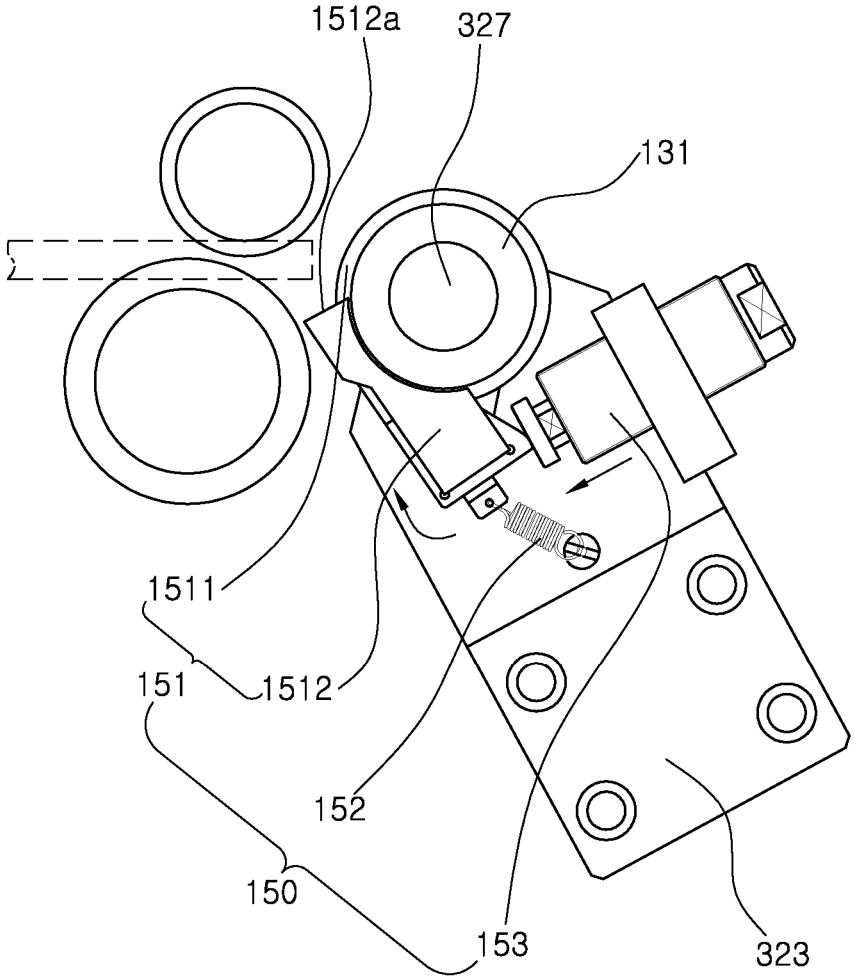
FIG. 12 is a front view showing a condition before an operation of the bending unit according to the present invention.
Figure 13:
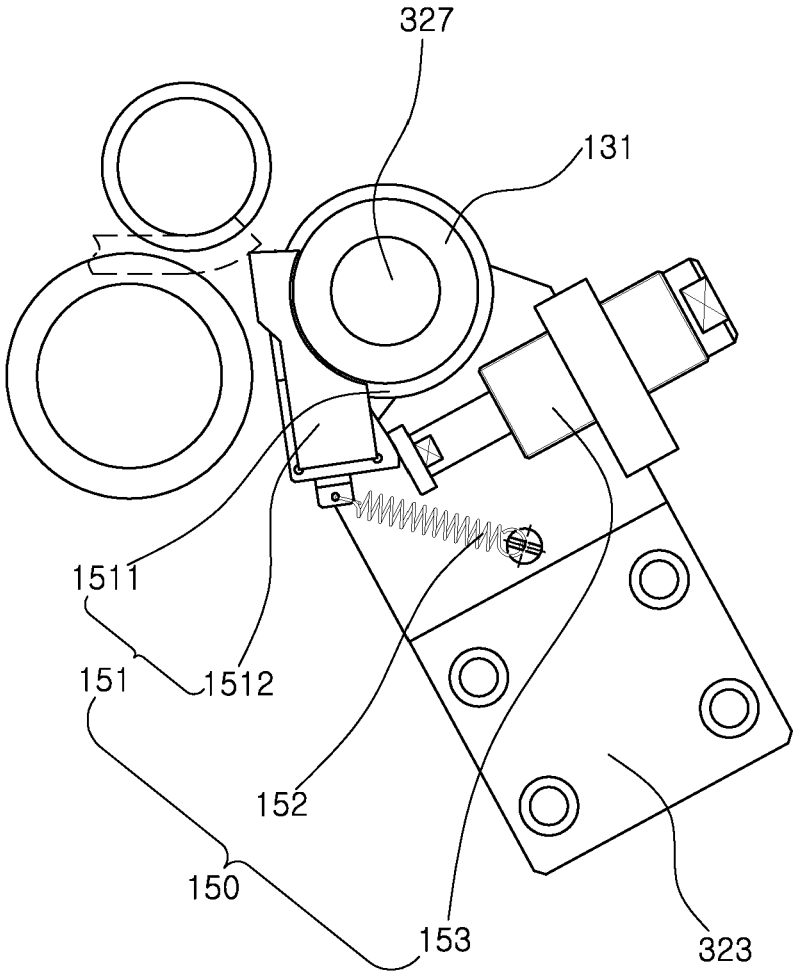
FIG. 13 is a front view showing the operation of the bending unit according to the present invention.

FIG. 12 is a front view showing a condition before an operation of the bending unit according to the present invention, and FIG. 13 is a front view showing the operation of the bending unit according to the present invention.

The bending unit 150 is constructed together with the first forming roll 131 of the forming roll 130 that is disposed near the feeding roll 120, and comprises a bending pusher 151, a spring 152 and a bending actuator 153.

The bending pusher 151 comprises a coupling part 1511 rotatably fitted over the rotating shaft 327 for supporting the first forming roll 131 and a bar-shaped actuating part 1512 integrally formed with the coupling part 1511. When the bending pusher 151 rotates about the rotating shaft 327, an end of the actuating part 1512 pushes and thus bends the leading end of the wire.

The spring 152 functions to restore the bending pusher 151, which has been rotated to bend the wire, to the initial position. The spring 152 is installed in such a way that an end thereof is fixed to the actuating part 1512 and the other end thereof is fixed to the first actuator 323.

When the bending pusher 151 rotates to press the leading end of the wire by means of the bending actuator 153, the spring 152 is stretched and accumulates elastic force for restoring the bending pusher 151 to the initial position. When the force that is applied to the bending pusher 151 by the bending actuator 153 is released, the bending pusher 151 is restored to the initial position by the accumulated elastic force.

The bending actuator 153 is installed at the first actuator 323 to be disposed on a lateral surface of the actuating part 1512. When it is required to bend the wire, the bending actuator 153 pushes the lateral surface of the actuating part 1512 so as to rotate the bending pusher 151. The bending actuator 153 may be composed of a hydraulic cylinder or an electric cylinder.

Meanwhile, the hot coiling machine according to the present invention may further include a stopper 160 that stops the wire at a predetermined position such that the initial position of the wire can be accurately set prior to feeding the wire to between the center roll 110 and the feeding roll 120.

Figure 14:
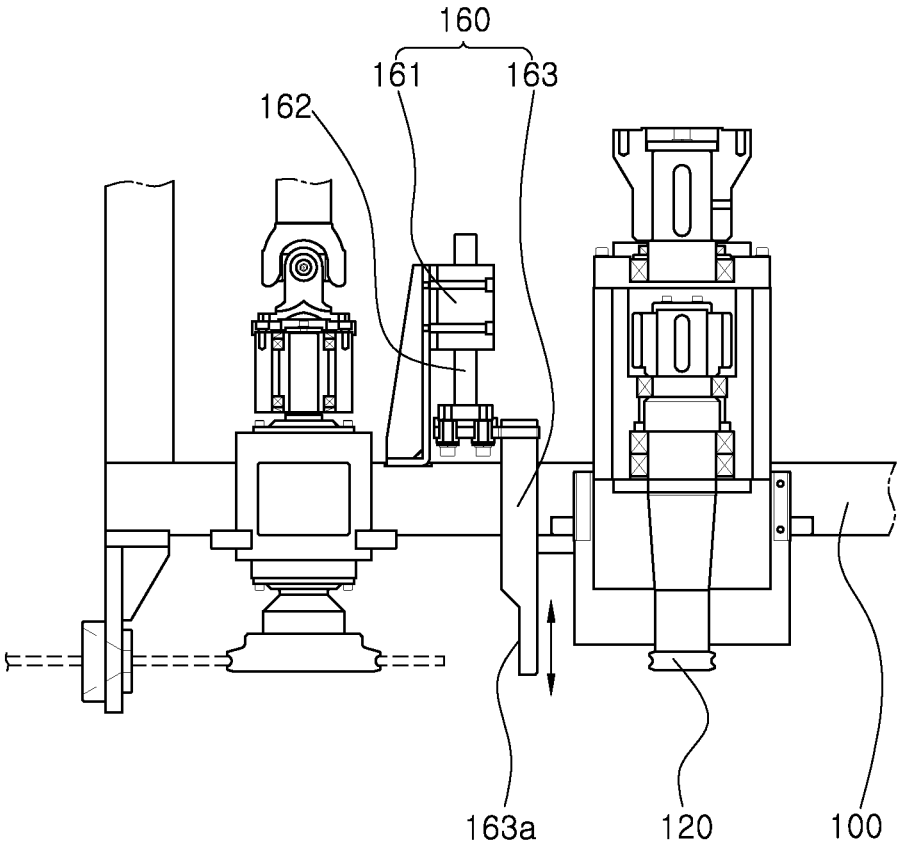
FIG. 14 is a plan view showing a structure of the stopper according to the present invention.

FIG. 14 is a plan view showing a structure of the stopper according to the present invention.

The stopper 160 comprises a cylinder 161 installed in the body 100, and a stop bar 163 that is coupled to a rod 162 of the cylinder 161 and moves together with the rod 162 to protrude forward from the front surface of the body 100, the stop bar 163 functioning to stop the wire at a predetermined position by blocking the advancing movement of the wire by means of the front end of the stopper protruding from the front surface of the body 100.

A lateral surface 163*a* of the stop bar 163 is configured to have a flat surface that comes into close contact with an end face of the wire and stops the wire at a predetermined position, and an end surface of the stop bar 163 has an approximate semicircular section.

Figure 15:
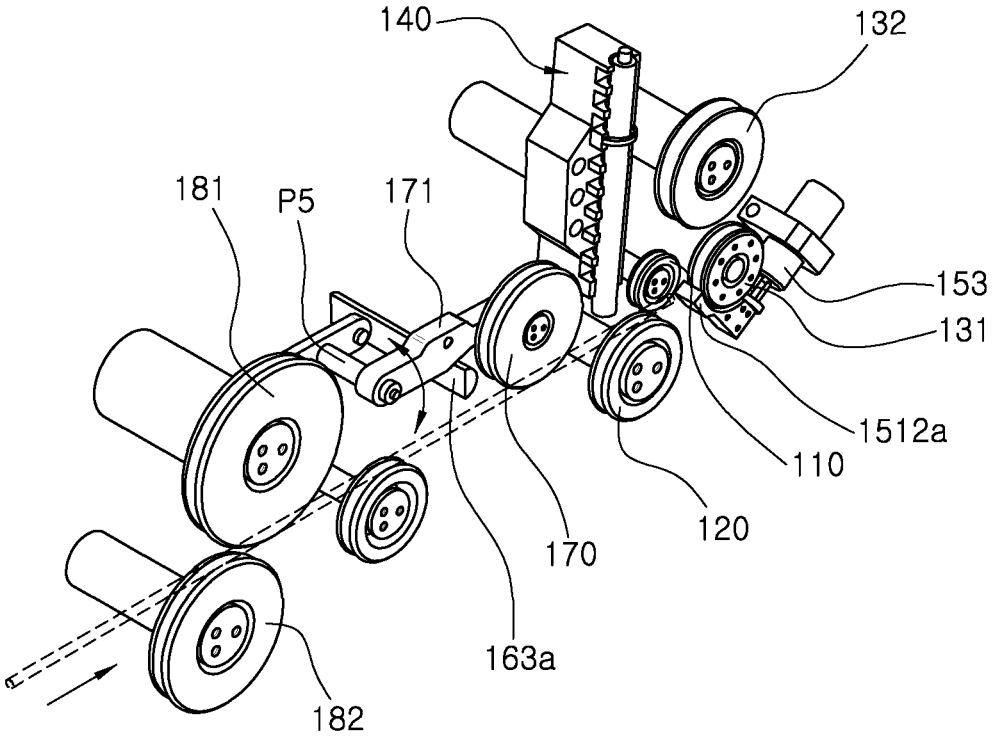
FIG. 15 is a perspective view showing a structure of a guide roll for supporting the wire fed between the center roll and the feeding roll.

FIG. 15 is a perspective view showing a structure of a guide roll for supporting the wire fed between the center roll and the feeding roll.

The hot coiling machine according to the present invention may further include the guide roll 170 for supporting and guiding the wire fed between the center roll 110 and the feeding roll 120. The guide roll 170 is positioned above a traveling path of the wire so as to support the wire while supplying a predetermined pressure to the wire by it's own weight.

More specifically, the guide roll 170 is positioned above the traveling path of the wire and near the center roll 110, and is supported by a lever 171 that is hingedly coupled to the body 100 to be rotatable about a hinge shaft P5.

The guide roll 170, which is installed in this way, comes into contact with an upper surface of the wire moving along the travelling path. At this point, the guide roll 170 applies a proper pressure to the wire by it's own weight thus assuring reliable travelling of the wire.

Meanwhile, reference numeral 180 of FIG. 3 denotes a feeding unit for transferring the wire to between the center roll 100 and the feeding roll 120.

For reference, the feeding unit 180 comprises an upper feeding roll 181 and a lower feeding roll 182. In this regard, the lower feeding roll 182 is installed in a stationary manner so as to rotate in place, and the upper feeding roll 181 is movable up and down by means of a cylinder 183 and is connected to a third drive motor 250 (see FIG. 5) via a universal joint 260 (see FIG. 5), so that the upper feeding roll 181 rotates to transfer the wire by a rotational force generated from the third drive motor 250.

The feeding unit 180 may be omitted if an additional feeding unit that is intended to supply the wire to the hot coiling machine can feed the wire to between the center roll 110 and the feeding roll 120.

A process of producing a hot coiled spring by the hot coiling machine that is constructed in this way will be described.

As well known in the art, for the production of a hot coiled spring, a wire is cut into a wire piece having a length corresponding to a spread length of a hot coiled spring to be produced, and the cut wire is subjected to a pretreatment in such a way as to heat the wire to a temperature required in the coiling work.

The wire that has been prepared by the pretreatment is introduced into the hot coiling machine by means of a feeding unit (not shown), and the wire that has been introduced into the hot coiling machine is stopped at a predetermined position by means of the stopper 160 provided at the body 100.

At this time, the first positioning unit 310 for adjusting a position of the feeding roll 120, the second positioning unit 320 for adjusting a position of the first forming roll 131, the third positioning unit 330 for adjusting a position of the second forming roll 132, and the bending unit 150 are moved to positions that are previously determined by a program installed in the controller for controlling the hot coiling machine.

For reference, the program is prepared to enable the components provided in the hot coiling machine to fulfill respective functions predetermined values and positions such as the speeds of rotation of the center roll 110 and the feeding roll 120 and positions of the first and second forming rolls 131, 132 in accordance with specifications of a coil spring to be produced.

After the preparation procedure is completed, the stopper 160 deviates from the travelling path of the wire, and the wire is transferred to between the center roll 110 and the feeding roll 120 by means of a feeding unit (not shown) or the feeding unit 180 provided at the body 100. When the wire is transferred by a distance determined by the program and thus the leading end of the wire enters between the center roll 110 and the feeding roll 120, the transfer of the wire is temporarily stopped and the feeding roll 120 moves close to the center roll 100 so as to hold the wire between the center roll 110 and the feeding roll 120.

Subsequently, the bending actuator 153 constituting the bending unit 150 is activated to rotate the bending pusher 151 about the rotating shaft. Consequently, the end of the wire is pushed by the actuating part 1512 of the bending pusher 151 and is thus bent in a turning direction of the wire.

When the bending actuator 153 is returned to the initial position, the bending pusher 151 is restored to the initial position by the force accumulated in the spring 152.

Thereafter, the center roll 110 rotates by means of the first drive motor 210 and the feeding roll 120 rotates by means of the second drive motor 220. Therefore, by the rotations of the center roll 110 and the feeding roll 120, the wire is transferred for the coiling work of the wire.

Since the hot coiling machine according to the present invention is configured to implement the transfer of the wire for the coiling work by means of both the rolls (the center roll 110 and the feeding roll 120), contact with the wire required for the transfer of the wire can be minimized and thus heat loss of the wire can be minimized.

The coiling work of the wire is fulfilled in such a way that the wire that is transferred by the rotations of the center roll 110 and the feeding roll 120 is first bent in the turning direction by the engagement with the external surface 131*a* of the first forming roll 131 and the wire that is deformed by means of the first forming roll 131 is further bent in the turning direction by the engagement with the external surface 132*a* of the second forming roll 132.

In the coiling work of the wire, since the diameter of the coiled wire can be changed by displacements of the first forming roll 131 and the second forming roll 132, not only a linear coil spring having a consistent diameter along a length but also various springs having a continuously varying diameter can be produced.

The wire that is deformed into a coil shape by means of the first forming roll 131 and the second forming roll 132 does not have a desired pitch because the first forming roll 131 and the second forming roll 132 are positioned on the same plane. The wire that is deformed into the coil shape through the second forming roll 132 is pushed by the contact member 141, and thus the coiled wire is further deformed into a coil spring having a desired pitch.

According to the present invention, since the first forming roll 131 and the second forming roll 132 that perform the coiling work of the wire are positioned on the same plane and the pitch of the coiled wire is adjusted by a separate contact member 141, a reliable contact between the wire and the forming roll 130 is achieved and thus damage to the surface of the wire can be prevented during the coiling work, thus assuring production of highly reliable coil springs.

By moving the contact member 141 to adjust a displaced distance of the wire while the coiled wire is provided with a desired pitch, the pitch of the resulting coil spring can be changed. At this point, when the contact member 141 is further moved during the coiling work of the wire, a coil spring having a varying pitch can be produced and a coil spring having different pitches at the opposite sides such as a sideload spring can also be produced.

As described above, the hot coiling machine according to the present invention produces a coil spring by a series of procedures in such a way that a wire is transferred by means of the center roll 110 and the feeding roll 120, the transferred wire is deformed into a coil shape by means of the first forming roll 131 and the second forming roll 132, and the wire deformed by the second forming roll 132 is pushed by the contact member 141, thus providing a coil spring having a desired pitch.

When the production of the coil spring is almost completed, a rear end of the wire is separated from the feeding unit 180. Subsequently, the wire is transferred by rotations of the center roll 110 and the feeding roll 120 with the rear end of the wire held by the guide roll 170, thus completing the coiling work.

While the hot coiling machine according to the present invention is preferably used in the production of a hot coiled spring from a heated wire, it can also be used in a production of a coil spring from a non-heated wire in some cases.

The present invention is not limited to the above-described preferred embodiment, those skilled in the art will appreciate that various modifications, additions and substitutions are possible, without departing from the scope and spirit of the invention as disclosed in the accompanying claims and the various modifications, additions and substitutions fall within the scope defined by the claims.

What is claimed is:

1. A hot coiling machine comprising:

a center roll configured to rotate by a rotational force generated from a drive unit;

a feeding roll disposed near the center roll and having an external surface facing an external surface of the center roll, the feeding roll being configured to move close to or away from the center roll by a first positioning unit and being rotated by the rotational force generated from the drive unit thereby moving a wire together with the center roll;

at least one forming roll for forming the wire transferred by rotations of the center roll and the feeding roll into a coil shape;

a pitch control unit disposed near the at least one forming roll to come into contact with the wire exiting the at least one forming roll and configured to push a lateral surface of the wire exiting the at least one forming roll to provide the wire with a pitch; and a bending unit for pushing a leading end of the wire fed between the feeding roll and the at least one forming roll to bend the leading end of the wire in a turning direction of the wire, wherein the bending unit comprises a bending pusher rotatably fitted over a rotating shaft of the at least one forming roll positioned near the feeding roll, a spring configured to restore the bending pusher to an initial position by an elastic force during bending of the wire by the bending pusher, and a bending actuator for pressing a lateral surface of an end of the bending pusher to rotate the bending pusher about the rotating shaft and thereby bending the leading end of the wire.

2. The hot coiling machine according to claim 1, wherein the pitch control unit comprises:

a contact member disposed to come into contact with the wire exiting the at least one forming roll while intersecting with the wire; and a pitch control actuator for pushing or pulling the wire to cause the contact member to move close to or away from the wire, thereby adjusting the pitch of the wire.

3. The hot coiling machine according to claim 2, wherein the pitch control actuator comprises:

a pitch control motor; and a slider coupled to a screw shaft extending from the pitch control motor and being moved along the screw shaft by rotation of the screw shaft, the slider being coupled to the contact member to move the contact member by the pitch control motor.

4. The hot coiling machine according to claim 2, wherein the contact member includes a roller that has an external surface in contact with the wire and is rotated by friction with the wire.

5. The hot coiling machine according to claim 2, wherein the contact member is configured such that, based on a vertical reference line that runs through a center of the contact member, an upper end of the contact member is positioned close to a second forming roll and a lower end of the contact member is positioned away from the second forming roll.

6. The hot coiling machine according to claim 1, wherein the bending actuator includes a hydraulic cylinder or an electric cylinder.

7. The hot coiling machine according to claim 1, wherein the at least one forming roll comprises:

a first forming roll disposed near the center roll and having an external surface facing the wire transferred by the center roll and the feeding roll, the first forming roll being moved close to or away from the center roll by a second positioning unit; and a second forming roll disposed near the first forming roll and having an external surface facing the wire deformed by the first forming roll, the second forming roll being moved close to or away from the center roll by a third positioning unit.

8. The hot coiling machine according to claim 1, wherein the first positioning unit comprises:

a hydraulic cylinder; and a movable block configured to move the feeding roll by the hydraulic cylinder.

9. The hot coiling machine according to claim 1, wherein the drive unit comprises:

a first drive motor;

a second drive motor;

a first universal joint connecting the first drive motor with the center roll; and a second universal joint connecting the second drive motor with the feeding roll.

10. The hot coiling machine according to claim 1, further comprising a stopper for stopping the wire at a predetermined position in order to set an initial position of the wire to be supplied between the center roll and the feeding roll.

11. The hot coiling machine according to claim 7, wherein the second positioning unit comprises:

a first base member;

a first positioning motor installed at the first base member;

a first actuator coupled to a first screw shaft extending from the first positioning motor and moving in a direction parallel to the first screw shaft by rotation of the first screw shaft, the first actuator including a rotating shaft for rotatably supporting the first forming roll;

a second base member;

a second positioning motor installed at the second base member; and a second actuator coupled to a second screw shaft extending from the second positioning motor and moving in a direction parallel to the second screw shaft by rotation of the second screw shaft, wherein an end of the second actuator is coupled to the first base member to push or pull the first base member.

12. The hot coiling machine according to claim 7, wherein the third positioning unit comprises:

a third base member;

a third positioning motor installed at the third base member;

a third actuator coupled to a third screw shaft extending from the third positioning motor and moving in a direction parallel to the third screw shaft by rotation of the third screw shaft, wherein an end of the third actuator includes a rotating shaft for rotatably supporting the second forming roll;

a fourth base member;

a fourth positioning motor installed at the fourth base member; and a fourth actuator coupled to a fourth screw shaft extending from the fourth positioning motor and moving in a direction parallel to the fourth screw shaft by rotation of the fourth screw shaft, wherein an end of the fourth actuator is coupled to the third base member to push or pull the third base member.

13. The hot coiling machine according to claim 1, further comprising a guide roll disposed near the center roll and above the wire supplied between the center roll and the feeding roll so as to press the wire and to support movement of the wire.

* * * * *